US006131383A

United States Patent [19]

Dinkelmann et al.

[11] Patent Number: 6,131,383

[45] Date of Patent: Oct. 17, 2000

[54] SPINNING MACHINE HAVING A DRAFTING FRAME PROVIDED WITH A SUCTION ROLLER

[75] Inventors: Friedrich Dinkelmann, Rechberghausen; Andreas Olbrich, Kirchheim, both of Germany

[73] Assignee: Zinser Textilmaschinen GmbH, Ebersbach/Fils, Germany

[21] Appl. No.: 09/285,583

[22] Filed: Apr. 2, 1999

[30] Foreign Application Priority Data

Apr. 3, 1998 [DE] Germany ..... 198 15 050

[51] Int. Cl.[7] ..... D01H 5/28

[52] U.S. Cl. ..... 57/315; 57/6; 57/75; 57/76; 57/328

[58] Field of Search ..... 57/6, 75, 76, 315, 57/328; 19/246, 286, 287

[56] References Cited

U.S. PATENT DOCUMENTS

| | | | |
|---|---|---|---|
| 4,757,680 | 7/1988 | Berger et al. | 57/328 |
| 5,085,046 | 2/1992 | Fehrer | 57/75 |
| 5,157,911 | 10/1992 | Stahlecker et al. | 57/328 |
| 5,285,624 | 2/1994 | Stahlecker | 57/328 |
| 5,651,244 | 7/1997 | Lucca | 57/315 |

FOREIGN PATENT DOCUMENTS

| | | |
|---|---|---|
| 635590 | 7/1994 | European Pat. Off. . |
| 41 39 067 | 6/1993 | Germany . |
| 44 26 249 | 2/1996 | Germany . |

*Primary Examiner*—William Stryjewski
*Attorney, Agent, or Firm*—Herbert Dubno

[57] ABSTRACT

A spinning machine in which downstream of the drafting frame and as part thereof, beyond the output rollers thereof, a suction roller is provided above the roving and cooperates with at least one counterroller below the roving to condense the roving before it is wound up on a ring-spinning or pot-spinning station.

18 Claims, 6 Drawing Sheets

FIG. 5
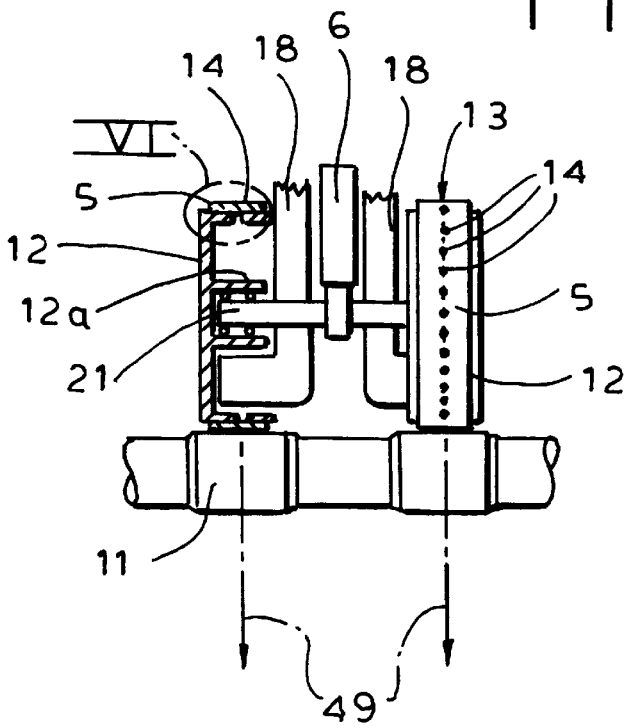
FIG. 6
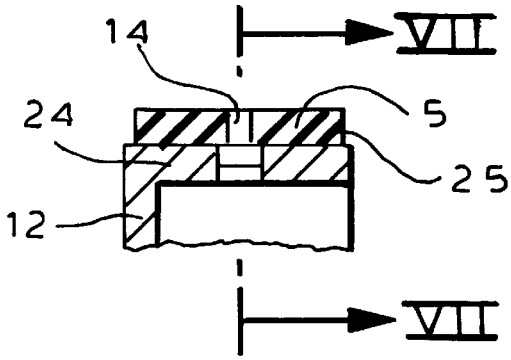
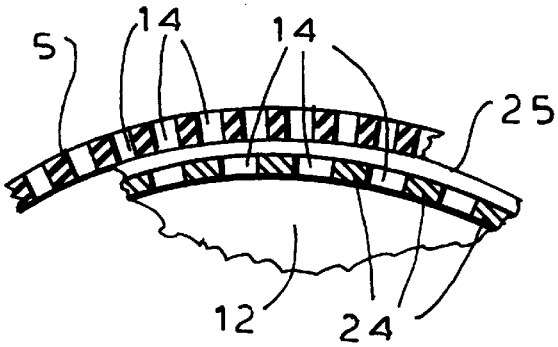
FIG. 7

SPINNING MACHINE HAVING A DRAFTING FRAME PROVIDED WITH A SUCTION ROLLER

FIELD OF THE INVENTION

Our present invention relates to a spinning machine having a drafting frame and, between the outlet pair of rolls of the drafting frame and a spinning station, a rotated suction roller or drum on the periphery of which a condensation or compaction of the drafted roving is effected at least in part by suction generated at a row or trace of perforations opening along the drum periphery. More particularly the invention relates to such a system in which the suction roller or drum is provided internally with a shield limiting the suction to only a portion of the peripheral row of perforations, i.e. to a so-called condensation or compaction zone. The term "perforation trace" or "perforation track" is used herein to refer to a line or row of suction orifices which are spaced apart from one another along the periphery or circumference, which open into the interior of the suction roller or drum and are thus evacuated through a chamber formed therein, and which open toward the roving so that the roving is drawn toward the trace, row or line of orifices, i.e. is compacted against the periphery of the suction roller or drum which may have a round or nonround contour.

BACKGROUND OF THE INVENTION

It is typical in a spinning machine to provide a drafting frame which can extend all along a side of that machine, over a large number of spinning stations, with pairs of rollers successively traversed by the roving from an inlet pair to an outlet pair, the rollers being driven at progressively higher peripheral speeds so that the roving is drawn to the desired fineness.

Such a drafting frame may comprise lower rollers which extend the full length of the drafting frame and cooperate with upper rollers which can be mounted on weighting or loading arms, the latter pressing the upper rollers against the lower rollers and clamping the roving between the upper and lower rollers of the respective pairs. The upper rollers can be individual to a particular spinning station and, if desired, the upper rollers can be twinned, with one upper roller of each twinned roller arrangement, being provided on each side of the arm. The continuous rollers, i.e. the lower rollers which extend the full length of the drafting frame, may be milled or otherwise modified in the regions juxtaposed with the upper rollers to increase their grip on the roving which is to be drafted.

The roving, after drafting, passes to a spinning unit which may be a ring-spinning station or a pot-spinning station or the like where a twist is imparted to that roving and the roving can be wound up in a yarn body, e.g. a bobbin in the case of a ring-spinning apparatus or a yarn cake in the case of a pot-spinning station.

It is known from German patent document DE 44 26 249 A1 to subject a roving at the outlet side of a drafting frame to the suction action of a suction roller provided as a lower roller beneath the stretching field plane of the drafting frame and thus engaging the roving from below. This suction roller or drum, over the top of which the roving passes, serves to compact the roving and to densify it. For this purpose a perforation trace is provided in the suction roller and in the region in which the roving passes over it so that fibers are drawn toward the trace.

It will be understood that the roving emerges from the drafting frame at a certain width and upon passing onto the suction roller is drawn inwardly toward the perforation trace and is thereby compacted. The compacted roving then passes from the suction roller to the twist-imparting unit. As noted, the latter can as a rule be a ring-spinning station in which a spindle cooperates with a ring surrounding the spindle and on which a traveler orbits, the yarn passing through the traveler and being wound on the spindle from the traveler. The twist-imparting unit and the unit collecting the yarn body can, however, also be a pot-spinning station.

The suction roller or drum has a larger diameter than the remaining drafting frame rollers since it is hollow and in its interior may receive a shield which is nonrotatable but which confines the suction to a limited portion of the periphery of the drum, namely, that portion over which the roving lies in contact with the drum.

For example, when the suction drum is provided as a bottom roller and the twist extends back to the nip between the suction drum and a counter roller, the contact of the twist with the arcuate drum surface can be excessive. The hairiness of the yarn which is ultimately produced, i.e. the number of fibers which jut out from the condensed roving and the twisted yarn, the number of yarn breaks which arise and the overall quality of the yarn are all adversely affected by the fact that the suction roller or drum is a large diameter body and particularly of a diameter greater than the diameter of the other lower rollers of the frame. It has also been found that problems arise in the delivery of the roving into the zone in which twist is imparted thereto. The problem appears to be due to the fact that yarns whose fibers have staple lengths like those of cotton, i.e. of about 25 mm to about 40 mm, require drafting rolls, at least at the output of the drafting frame with diameters of 25 to 35 mm and this could not be achieved in the earlier systems described with such suction rollers or drums as the last lower roller from which the roving passed before receiving the twist.

OBJECTS OF THE INVENTION

It is the principal object of the present invention, therefore, to provide an improved spinning machine whereby these drawbacks and other disadvantages of earlier spinning machines are obviated.

Another object of the invention is to provide a spinning machine of the type described, i.e. of the type provided with a drafting frame, a suction roller roving compactor or condenser, and a system for imparting twist to the roving, whereby the hairiness of the yarn can be reduced, the tendency to breakage of the yarn can be reduced, and the overall yarn quality can be increased.

Still another object of the invention is to provide a spinning machine capable of producing in a versatile manner, especially high quality yarn.

SUMMARY OF THE INVENTION

These objects and others which will become apparent hereinafter are attained, in accordance with the invention by providing the suction roller or drum so that it is disposed above the stretching field plane and is juxtaposed with at least one lower roller whose diameter is customary for the particular fibers processed and from which the roving is fed to the zone in which the twist is imparted to it. The twisted yarn then does not lie significantly along the arcuate surface of the suction roller. The reference to the diameter of the lower roller juxtaposed with the suction roller as being of a diameter which is customary for the fibers processed, means in the case of cotton fiber rovings with a staple length of 25 to 40 mm, a diameter of 25 to 35 mm and in more general terms to a diameter which corresponds to the diameter of the lower rollers of the drafting frame and more specifically to the diameter of the last lower roller of the drafting frame. The term "corresponding" as here used means that the diameter of the lower roller of the condensing or compaction unit should be within ±5% of the diameter of the last lower roller, i.e. of the lower roller of the output pair of the drafting frame.

More particularly, the spinning machine according to the invention can comprise:

a drafting frame provided with a plurality of pairs of rollers, each including a lower roller and an upper roller, driven at successively higher peripheral speeds for drafting respective roving and outputting the drafted rovings from between respective output roller pairs;

a suction roller engageable from above with each of the drafted rovings downstream of the respective output pair of rollers and provided with a row of perforations in a circumference of the suction roller, means for applying suction to an interior of the suction roller, and a shield in the suction roller confining the application of suction to a limited portion of the row, thereby forming a compaction zone at which suction is applied to a respective roving through the perforations along the compaction zone to condense the roving;

a driven counter roller pressing against the roving from below at a downstream end of the compaction zone and rotatable entraining the suction roller, the suction roller and the counter roller defining a nip at which a condensed roving emerges; and means for receiving the condensed roving and imparting twist to the condensed roving and for collecting the twisted condensed roving as a yarn in a yarn body, the twist imparted to the condensed roving traveling to the nip, the counter roller having a diameter which corresponds to diameters of the lower rollers of the pairs of rollers of the drafting frame.

To avoid a metal to metal contact between the suction roller and its lower roller, at least one of them, preferably the suction roller, can be provided with an elastic jacket.

In that case, the perforations can be bores or orifices extending through the elastic jacket and opening into a groove along the interior of the elastic jacket or in the exterior of the metal suction roller wall on which that jacket is mounted, additional bores connecting the interior of the suction roller with the groove. The orifices in the jacket of course can also be aligned with orifices in the metal wall of the suction roller, although such alignment is not required if grooves are provided as has been described. The use of grooves allows the radial bores or orifices in the jacket and outer wall of the suction rollers to be distributed differently and to be different in number.

To prevent the roving from falling away from the orifices of the suction roller or drum upon interruption in the roving or under the influence of a spurious current or jet of air, a lower roller beneath the roving and juxtaposed with the suction roller or drum can be looped by a transport belt reaching toward the output pair of rollers of the drafting frame, the belt being guided over conventional means such as a guide rail or the like close to the nip of the output roller pair. The transport belt then carries the roving to the suction roller and prevents tearing.

The compaction of the roving supplied by the drafting frame in the manner described has the advantage that the roving itself is drawn tightly together as it enters the twisting zone in which it is stabilized to a yarn by the twisting action. The tightly compacted roving receives a twist which thus jumps back to the nip between the suction roller and its lower roller so that the spinning triangle is relatively short. As a consequence, losses of fibers which break away from the periphery of the roving are minimal and the yarn has reduced hairiness. This effect can be accompanied by imparting twist to the roving with a thread-balloon-free spinning operation or by carrying out a spinning operation with a reduced thread balloon. Balloon-free or low balloon spinning reduces the thread tension in the yarn between the output roller pair of the drafting frame and the tip of the spindle and increases the twisting density in this part of the yarn. Apparently this effect is promoted by the compaction of the roving.

One possible arrangement for thread balloon-free or reduced balloon spinning can be accomplished by winding the roving on a spindle formed with a spinning finger or spinning crown. Another possibility for thread balloon-free spinning can be accomplished by a pot-spinning operation. Pot-spinning also reduces the thread tension in the stretch between the location at which the yarn is received by the spinning pot and the output roller pair of the drafting frame by comparison to a ring-spinning system.

When a roving is spun as it is received on a ring-spinning spindle for example from the drafting frame and its condensing unit, a simple yarn is made. When, however, two rovings are drafted in parallel without prior twisting and then are passed over a common condensing roller or drum having respective perforation traces and then united so that the previously untwisted rovings are twisted one around the other, a mock yarn is made in accordance with the invention.

BRIEF DESCRIPTION OF THE DRAWING

The above and other objects, features, and advantages will become more readily apparent from the following description, reference being made to the accompanying drawing in which:

FIG. 5 is an elevational view, partly broken away, of a portion of the compacting or condensing unit of FIG. 1;

FIG. 6 is a detail view of a larger scale of the region VI—VI of FIG. 5;

FIG. 7 is a section along the line VII—VII of FIG. 6;

SPECIFIC DESCRIPTION

Figure 1:
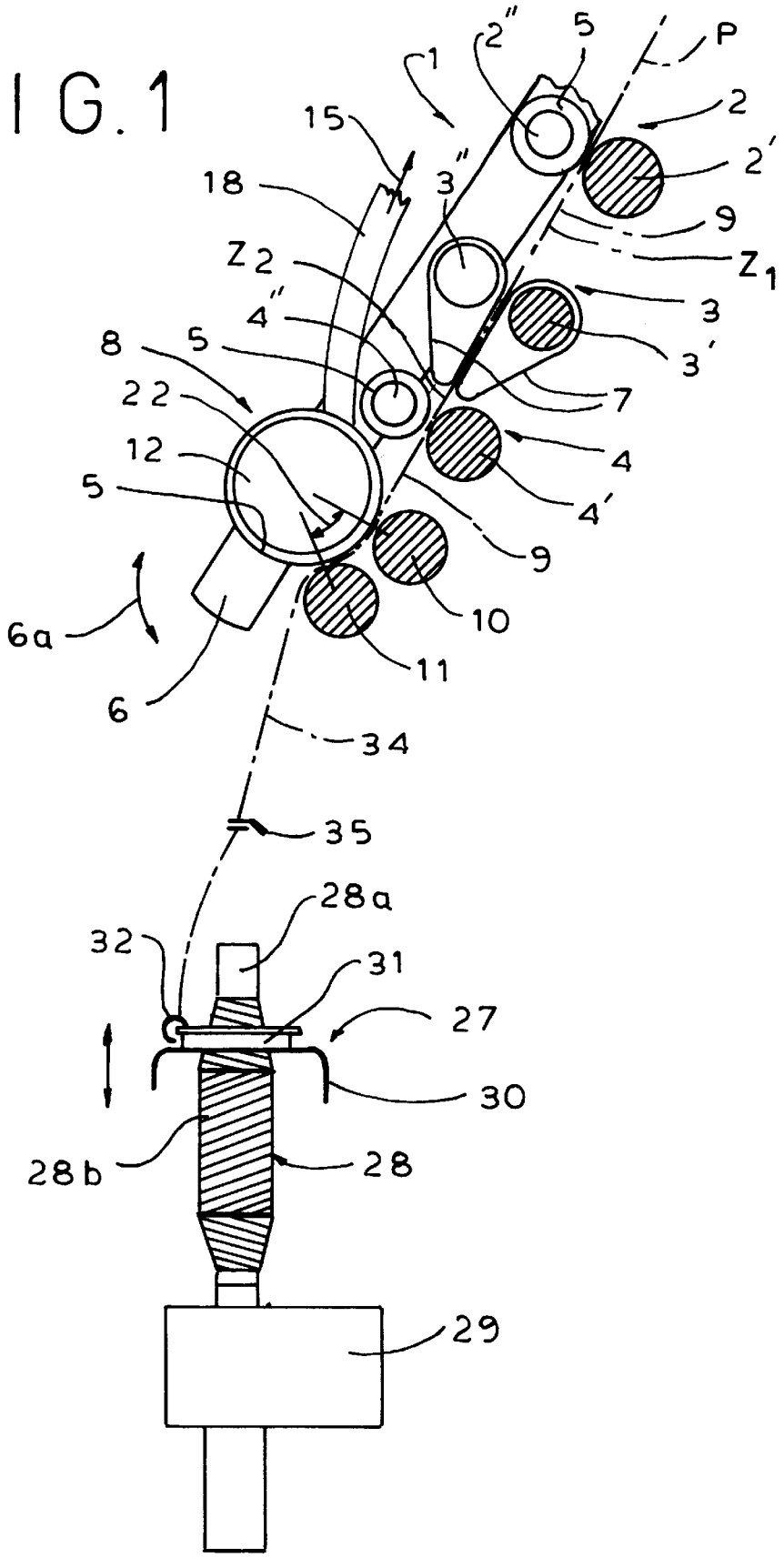
FIG. 1 is a transverse section through a spinning machine according to the invention utilizing a reduced thread balloon and ring-spinning station for imparting twist to the yarn.

FIG. 1 shows a drafting frame 1 which is largely of conventional design and has an input pair of rollers 2, a middle pair of rollers 3 and an output pair of rollers 4. The pairs of rollers are driven in progressively higher speeds so that in the stretching plane P the roving 9 is stretched in a zone Z1 between the inlet pair of rollers 2 and the intermediate pair of rollers 3 and in the zone Z2 between the middle pair of rollers 3 and the output pair of rollers 4. The drafted roving is delivered at 9 with the desired fineness in the form of a band whose width depends upon the relative speeds of the rollers and the diameter of the sliver introduced to the intake roller pair 2.

The lower rollers 2', 3' and 4' of these roller pairs are steel rollers extending the full length of the drafting frame of the spinning machine and have, in the regions in which the roving is engaged at each of the spinning stations, milling or knurling to increase the grip of the roller on the roving.

Upper rollers 2", 3" and 4" are twin rollers, i.e. as in the case of the suction rollers shown in FIG. 5, are mounted in pairs on opposite sides of a support and loading arm 6 which is swingable in the direction of arrow 6*a* and/or spring loaded as desired. The upper suction rollers can be carried on such arms as well. When the arm 6 is raised, access is provided to the roving path between the upper and lower rollers.

The rollers 3' and 3" of the middle roller pair 3 are equipped with belts 7 guided over belt cages and mounted, respectively, on the stand of the drafting frame and the arm 6.

The drafting frame 1 is provided with a compaction unit 8 for each of the stations and each compaction unit 8 acts upon a nonstabilized roving 9, i.e. a roving which has not been stabilized by twisting. A variety of compacting and condensing systems can be used, although in each case a suction roller 12 is provided above the roving 8 to cooperate with at least one and preferably with two lower rollers or counterrollers 10 and 11 disposed along the underside of the roving. The lower rollers or counterrollers 10 and 11 have their nips at the upstream and downstream ends of a condensing or compaction zone 22 to be described in greater detail hereinafter. The rollers 10 and 11 can be steel rollers which, like the lower rollers 2', 3' and 4', can extend the full length of the drafting frame.

The upper roller 12 can be an individual roller or can be one of a pair of twin upper rollers (FIG. 5) mounted on a common axle 21 on the loading arm. Each roller 12 can have a sleeve 12*a* supported by ball bearings on the axle 21, here shown as a shaft or pin transverse to the arm 6. Each upper roller 12 is a suction condensing roller and for this purpose is hollow and is provided over its periphery with a perforation arrangement 13 in the form of a multiplicity of suction orifices lying in a row.

Figure 4:
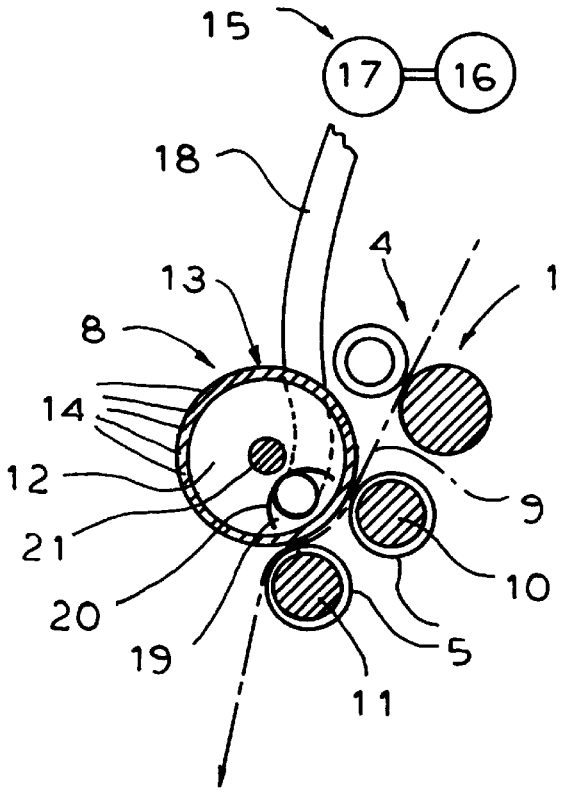
FIG. 4 is a sectional view through the drafting frame in another embodiment of the invention.

In FIG. 4, the suction roller 12 is shown in section through the plane of the orifices. Within the suction roller 12 a suction source 15 generates a subatmospheric pressure or suction. The suction source 15 can be a suction pump 17 driven by a motor 16 and connected with a suction chamber 19 within the rotor 12, the chamber 19 being defined by a shield 20 which is open toward the perforations and delimits the condensing zone between the nips of the rollers 10 and 11 with that suction roller 12 (see FIG. 4).

Figure 8:
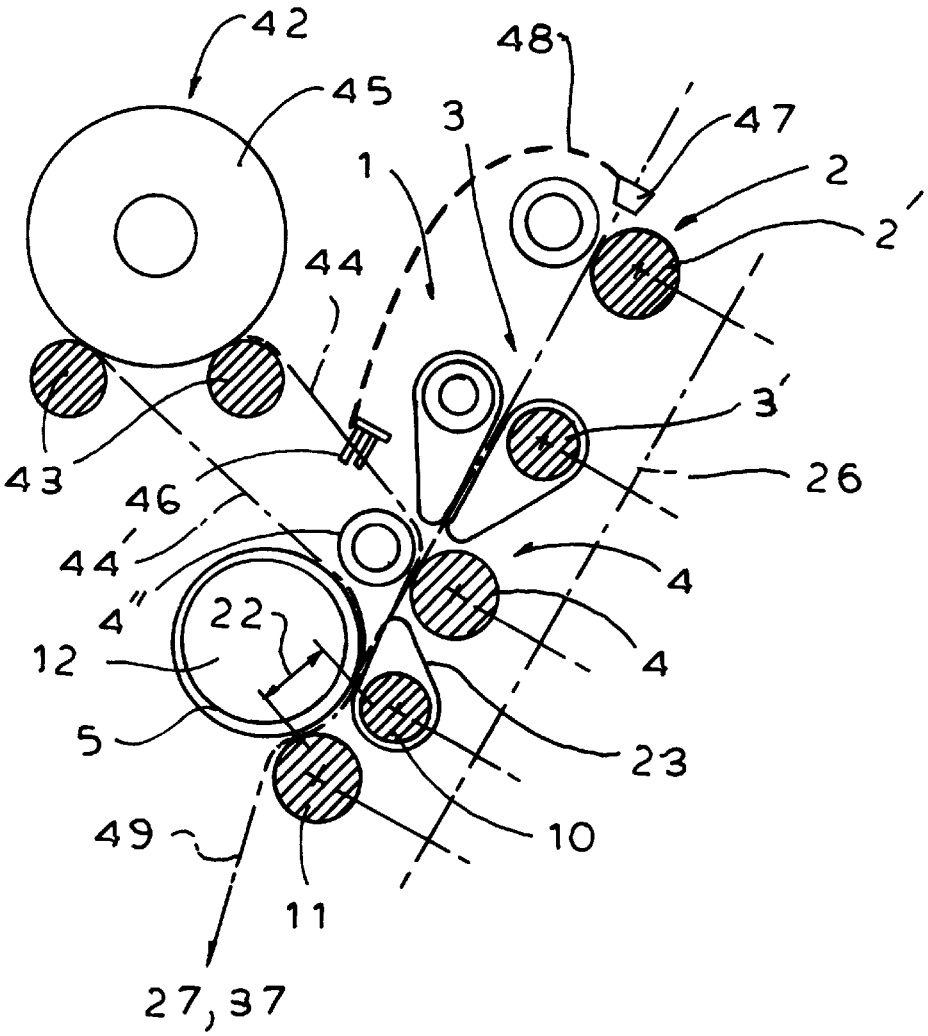
FIG. 8 is a view similar to FIG. 4 of an apparatus for producing a core yarn according to the invention.

The upstream counterroller 10 can, as shown in FIG. 8, be looped by a transport belt 23 which can otherwise be supported by a cage or a bar, and which reaches toward the output roller pair 4. The belt 23 serves to support the roving 9 between the nip of the output roller pair and the upstream end of the compaction zone 22. The drafting frames of FIGS. 1, 4 and 8 have thus five lower rollers 2', 3', 4', 10 and 11.

Figure 9:
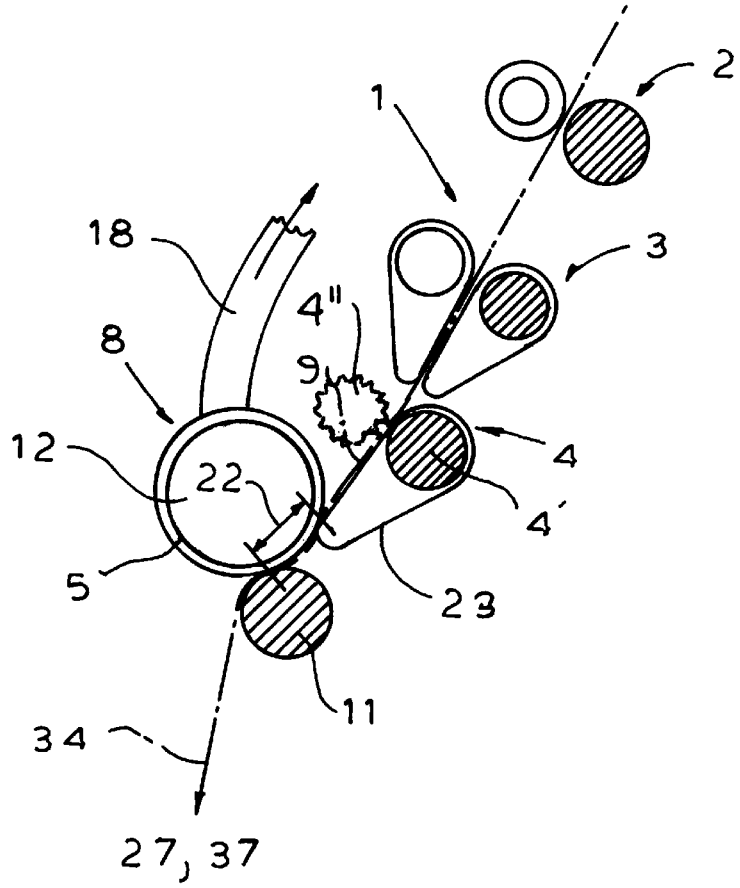
FIG. 9 is still another view in section of a drafting frame provided with a condensing unit in accordance with the invention.

In some cases (FIG. 9) the lower roller 10 is eliminated and its function can be assumed in part by a belt 23' looped around the lower roller 4 and extending to the upstream side of the compaction zone 22. The belt 23' prevents the roving 9, although unstable from separating or dropping out of the roving path when disturbed by a current of air or the like. The upper roller 4" in this case can be a milled steel roller (FIG. 9).

The downstream counterroller 11, from which the roving is drawn off and to which the twist in the yarn 34 rises, has a diameter which is selected for the particular staple fiber being processed and in the case of cotton is preferably 27 mm to 32 mm. As a rule the rollers 10 and 11 will have diameters similar to those of the rollers 2', 3', 4'.

As a rule the suction roller 12 will be composed of steel and to avoid metal to metal contact between its periphery and the steel counterrollers 10 and 11, which can lead to wear, noise and slip, either the suction roller 12 or the counterrollers 10, 11 can be provided with an elastic jacket 5. In the embodiments of FIGS. 1, 5, 8 and 9, the suction roller 12 is provided with the elastic jacket 5. In FIG. 4 the counterrollers 10 and 11 each have elastic jackets 5.

Figure 11:
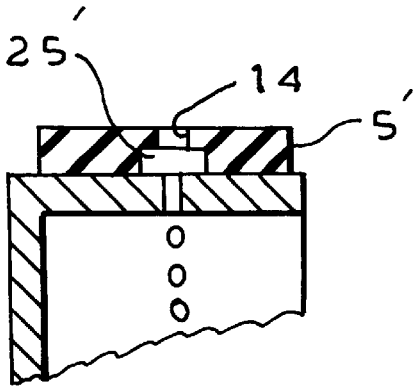
FIG. 11 is a view similar to FIG. 6 of another embodiment of the invention.

When the suction roller 12 is formed with the elastic jacket 5, the orifices in the jacket 5 must be aligned with the openings or passages in the cylindrical wall 24 of the suction roller. Such an alignment can be ensured if the holes or orifices are formed after the jacket 5 is applied to the wall 24. Since the jacket 5 may have to be replaced, the problem of alignment can be eliminated by providing, as shown in FIGS. 6 and 7 the wall 24 with a circumferential groove 25 with which openings 14 communicate between the interior of the suction roller and the groove. Alternatively as shown in FIG. 11 the groove can be formed in the jacket 5' as shown at 25'.

The lower rollers 2', 3' 4' of the drafting frame 1 and the lower rollers 10 and 11 of the condensing device are driven by a drive represented in dot-dash lines at 26 in FIG. 8 at the appropriate adjustable relative speeds.

The twist-imparting mechanism in the embodiment of FIG. 1, downstream of the condensing unit 8, is a conventional ring-spinning station 27 with its spinning spindle 28 mounted on a spindle rail 29 which contains its drive and bearing system. It will be understood that the rail 29 carries a multiplicity of such spindles each having a respective thread guide eye 35 for the yarn 34 which is supplied from the nip between the respective suction roller 12 and the counterroller 11. The spindle 28 carries sleeve 28*a* upon which the body of yarn 28*b* is formed as a bobbin. A ring rail 30 is vertically displaceable relative to the spindle to distribute the yarn therealong and carries, for each spindle, a spinning ring 31 on which a traveler 32 orbits. The system shows in FIG. 1 permits the formation of a small thread or yarn balloon between the eye 35 and the traveler 32.

Figure 2:
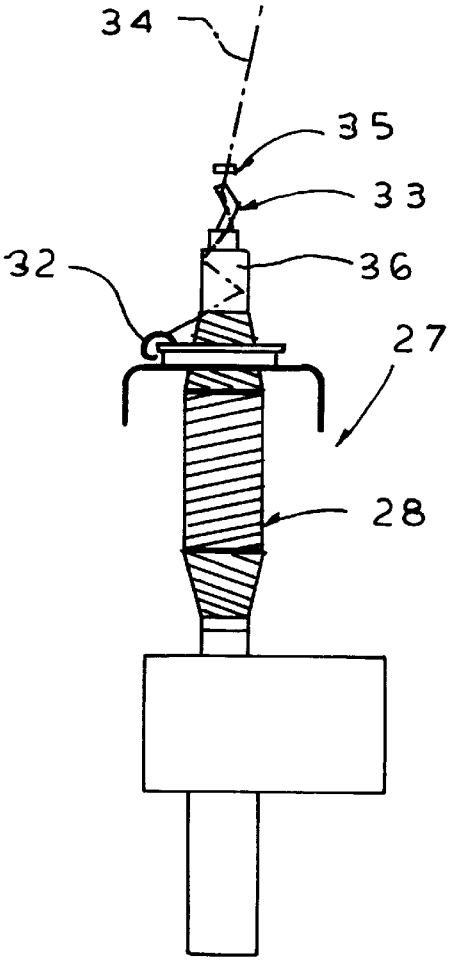
FIG. 2 is a balloon-free ring-spinning station which can be substituted for the ring-spinning station of FIG. 1 shown in elevation.

For balloonless or reduced-balloon spinning, the spindle 28 (FIG. 2) can be provided on its tip with a spinning finger 33 which captures the yarn 34 immediately below the thread guide 35 and loops the yarn around the tube or sleeve 36 from which it is guided without a balloon to the traveler 32.

Figure 3:
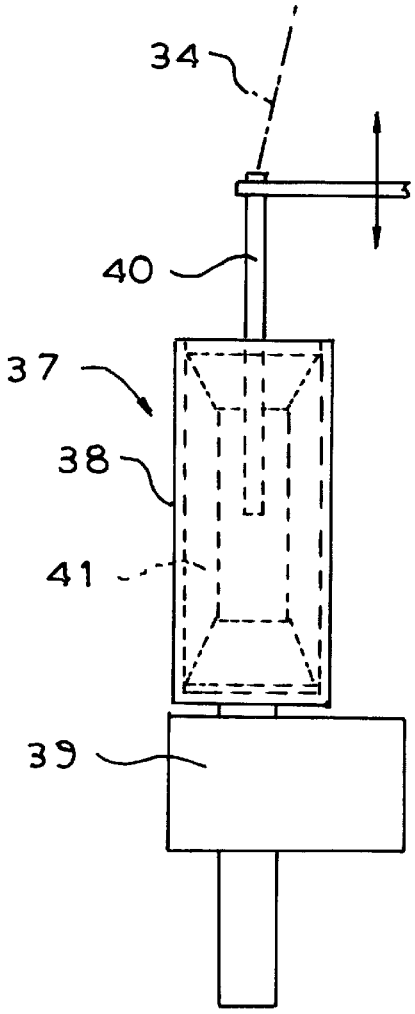
FIG. 3 is a view similar to FIG. 2 of a pot-spinning station for balloon-free twisting of the yarn.

FIG. 3 shows a twisting unit in the form of a pot-spinning station 37 which can be part of the conventional pot-spinning machine, e.g. as described in U.S. Pat. No. 5,613,355. This pot-spinning station 37 comprises a spinning pot 38 whose drive and bearing system are contained in the pot rail 39 and which cooperates with a vertically movable yarn guide tube 40 which deposits the spun yarn in a spinning cake 41 in the spinning pot.

In operation, the drafting frame 1 delivers its roving 9 from the output roller pair 4 to the condensing device 8 as a strip whose width is determined by the diameter of the incoming sliver and the drafting action in the drafting frame. The roving 9 is fed via the transport belt 23 of FIG. 8, the transport belt 23' of FIG. 9 or, without a transport belt, by the conveying action of the roller pair 10, 12 to the compaction zone 22. Where the roving is subjected to suction through the orifices 14 and the perforation zone 13, the suction draws laterally lying fibers toward the center and hence compacts the roving. In this compacted state, the roving is delivered from the nip between the counterroller 11 and the suction roller 12 to the ring-spinning station 27 or the pot-spinning station 37 in which the yarn is twisted and collected in a bobbin or yarn cake.

The apparatus of the invention can be used to make a core yarn if a core thread feeder 42 is provided (see FIG. 8). The core yarn is a yarn in which an endless synthetic core thread or filament is surrounded by fibers usually being cotton or wool fibers. As can be seen from FIG. 8, the drafting frame 1 can be provided with two feed rollers 43 which can extend the full length of the drafting frame and can be driven like the lower rollers 2', 3', 4' 10 and 11 and on which a spool 45 carrying the core thread 44 can be mounted. The core thread 44 is passed through a thread guide 46 over one of the rollers 43 to the upstream side of the upper roller 4" of the output roller pair 4 and, centered on the roving 9, passes therewith to the condensing zone 22. The feed rollers 43 are driven with a smaller peripheral speed than the output pair 4 of rollers so that the core thread is stretched 2.5 to 5 times before it is engaged in the nip of rollers 4. The core thread 44 is then laid into the roving at the speed with which the roving leaves the main drafting field between the roll pairs 3 and 4.

Since the perforations 13 of the suction roller 12 do not shift back and forth in the axial direction of the drafting frame rollers, the range over which the suction is effective is relatively limited. The roving however does not change in width significantly and hence the core thread 44 can be laid centrally into the roving without particular concern. However, with a tendency of the roving to shift back and forth, or where the core thread 44 may shift back and forth, we can couple the thread guide 46 to the inlet funnel 47 of the sliver as represented by the broken line 48 so that the centering of the roving to the core thread or vice versa is always ensured. In other words the core thread guide and the sliver guide are so coupled that the core thread will always be placed centrally on the roving and, as the roving is compacted by the suction, the core thread will be fully, uniformly and completely enveloped by the roving fibers. As FIG. 8 also shows, the core thread 44' can, alternatively, be fed to the compaction zone 22 directly at the upstream side thereof on the suction roller 12. The thread guide 46 will also be provided in this case although it has not been shown.

Figure 10:
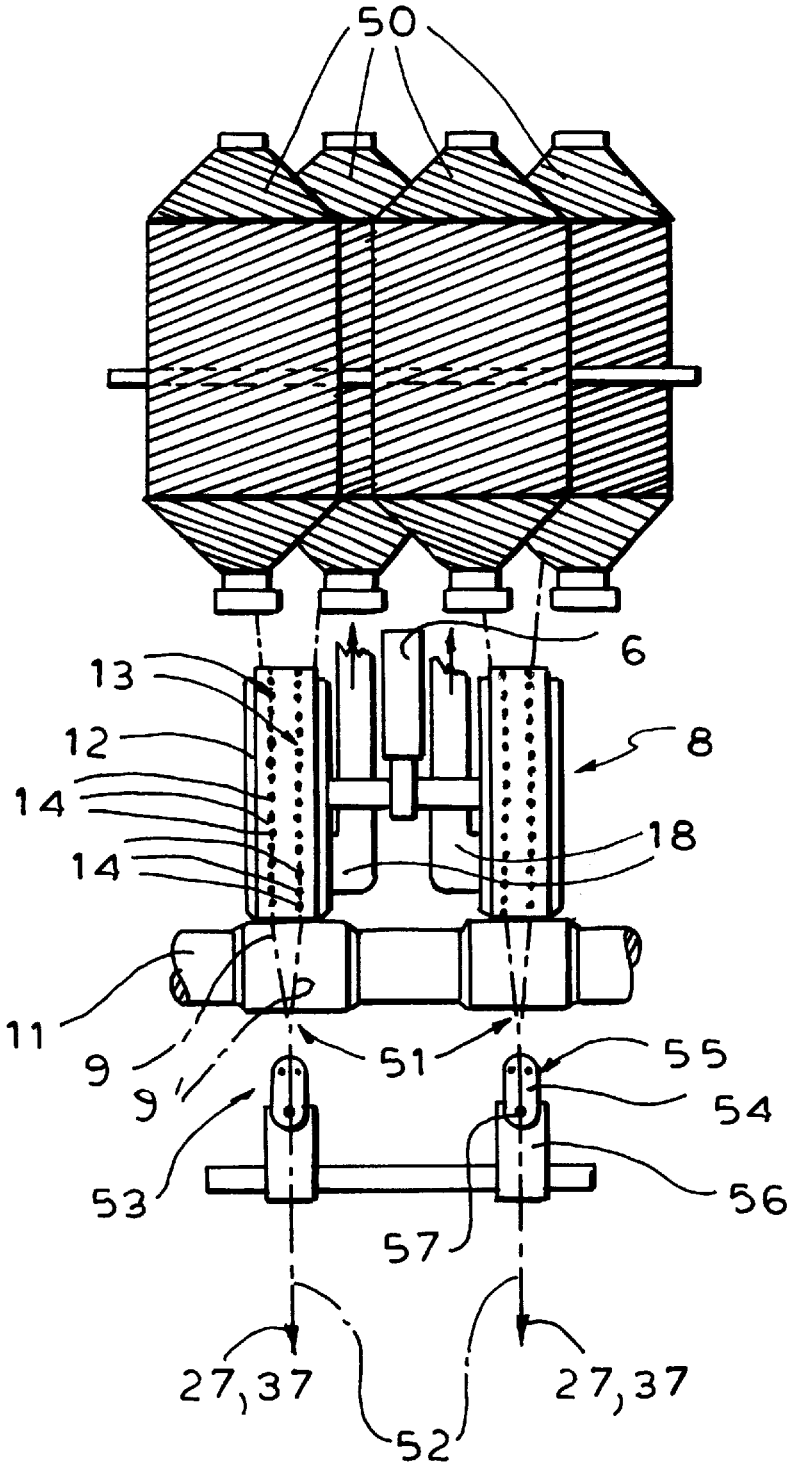
FIG. 10 is an elevational view showing two stations for the production of mock yarns.

In FIG. 10, we have shown how the system can be used to produce mock yarn. In this case, the suction rollers 12 can each be provided with perforated circumferences 12 having two rows of orifices 14. The untwisted rovings from the sliver bobbin 50 are passed through the respective drafting rolls without twisting and the untwisted roving in parallel pairs at 9 and 9' then are compacted using the respective rows of suction orifices 14. The rovings then join at 51 and are twisted together in a pot-spinning station 37 to form the mock yarn 52. So that the yarn does not continue to pass to the twisting station in the case of breakage of one of the rovings, the yarn passes between a pair of pins 55 on a swingable catch 54 which is provided on a support 56. In the event of breakage of one of the rovings, the catch 54 swings about the respective pivot axis so that the remaining roving will loop about one of the pins and catch thereon so that it will break as well.

The rovings used for producing a mock yarn 52 in FIG. 10 can also be provided with core threads utilizing the system of FIG. 8.

Of course the various components described in the several Figures, namely, the drafting frame 1, the compaction unit 8, the twisting stations 27 or 37, the spinning finger 43, the core thread feeder 42 and the system for producing the mock yarn can be used interchangeably and in any combination within the scope of the present invention.

We claim:

1. A spinning machine comprising:

a drafting frame provided with a plurality of pairs of rollers, each including a lower roller and an upper roller, driven at successively higher peripheral speeds for drafting respective roving and outputting the drafted rovings from between respective output roller pairs;

a suction roller engageable from above with each of said drafted rovings downstream of the respective output pair of rollers and provided with a row of perforations in a circumference of said suction roller, means for applying suction to an interior of said suction roller, and a shield in said suction roller confining the application of suction to a limited portion of said row, thereby forming a compaction zone at which suction is applied to a respective roving through the perforations along said compaction zone to condense the roving;

a driven counter roller pressing against said roving from below at a downstream end of said compaction zone and rotatable entraining said suction roller, said suction roller and said counter roller defining a nip at which a condensed roving emerges; and means for receiving said condensed roving and imparting twist to said condensed roving and for collecting the twisted condensed roving as a yarn in a yarn body, the twist imparted to said condensed roving traveling to said nip, said counter roller having a diameter which corresponds to diameters of the lower rollers of said pairs of rollers of the drafting frame, said suction roller having a diameter substantially greater than the diameter of said counter roller.

2. The spinning machine defined in claim 1 wherein said suction roller is one of a twinned upper roller pair downstream of said output rollers.

3. The spinning machine defined in claim 1 wherein two counter rollers are provided below said roving at opposite ends of said compaction zone, at least one of said counter rollers being driven.

4. The spinning machine defined in claim 1, further comprising a transport belt bridging between said output pair of rollers and said suction roller.

5. The spinning machine defined in claim 4 wherein said transport belt is looped around a counter roller below the roving and juxtaposed with said suction roller.

6. The spinning machine defined in claim 4 wherein said transport belt is looped around a lower roller of the output pair of rollers.

7. The spinning machine defined in claim 6 wherein said lower roller of said output pair of rollers is juxtaposed with a twinned milled upper roller.

8. The spinning machine defined in claim 1 wherein said means for receiving includes a spinning station provided with means for limiting thread-balloon formation.

9. The spinning machine defined in claim 8 wherein said spinning station is a thread-balloon-free pot-spinning station.

10. The spinning machine defined in claim 8 wherein said spinning station is a ring-spinning station.

11. The spinning machine defined in claim 1 wherein the suction roller has two rows of orifices and two parallel-drafted rovings are fed without twist by said drafting frame to said suction roller, said rovings being combined-on twisting into a mock yarn.

12. A spinning machine comprising:

a drafting frame provided with a plurality of pairs of rollers, each including a lower roller and an upper roller, driven at successively higher peripheral speeds for drafting respective roving and outputting the drafted rovings from between respective output roller pairs;

a suction roller engageable from above with each of said drafted rovings downstream of the respective output pair of rollers and provided with a row of perforations in a circumference of said suction roller, means for applying suction to an interior of said suction roller, and a shield in said suction roller confining the application of suction to a limited portion of said row, thereby forming a compaction zone at which suction is applied to a respective roving through the perforations along said compaction zone to condense the roving;

a driven counter roller pressing against said roving from below at a downstream end of said compaction zone and rotatable entraining said suction roller, said suction roller and said counter roller defining a nip at which a condensed roving emerges; and means for receiving said condensed roving and imparting twist to said condensed roving and for collecting the twisted condensed roving as a yarn in a yarn body, the twist imparted to said condensed roving traveling to said nip, said counter roller having a diameter which corresponds to diameters of the lower rollers of said pairs of rollers of the drafting frame, two counter rollers being provided below said roving at opposite ends of said compaction zone, at least one of said counter rollers being driven, each of said counter rollers having a metallic circumference, said suction roller being provided with an elastic jacket along the circumference thereof.

13. A spinning machine comprising:

a drafting frame provided with a plurality of pairs of rollers, each including a lower roller and an upper roller, driven at successively higher peripheral speeds for drafting respective roving and outputting the drafted rovings from between respective output roller pairs;

a suction roller engageable from above with each of said drafted rovings downstream of the respective output pair of rollers and provided with a row of perforations in a circumference of said suction roller, means for applying suction to an interior of said suction roller, and a shield in said suction roller confining the application of suction to a limited portion of said row, thereby forming a compaction zone at which suction is applied to a respective roving through the perforations along said compaction zone to condense the roving;

a driven counter roller pressing against said roving from below at a downstream end of said compaction zone and rotatable entraining said suction roller, said suction roller and said counter roller defining a nip at which a condensed roving emerges; and means for receiving said condensed roving and imparting twist to said condensed roving and for collecting the twisted condensed roving as a yarn in a yarn body, the twist imparted to said condensed roving traveling to said nip, said counter roller having a diameter which corresponds to diameters of the lower rollers of said pairs of rollers of the drafting frame, two counter rollers being provided below said roving at opposite ends of said compaction zone, at least one of said counter rollers being driven, said counter roller having a metallic circumference, said suction roller being provided with an elastic jacket along the circumference thereof.

14. The spinning machine defined in claim 13 wherein said elastic jacket is formed with throughgoing orifices opening into an evacuated circumferential groove formed in an outer periphery of said suction roller.

15. The spinning machine defined in claim 13 wherein said elastic jacket is formed with orifices opening into an evacuated circumferential groove formed in an inner wall of said jacket and communicating with bores formed in an outer periphery of said suction roller.

16. A spinning machine comprising:

a drafting frame provided with a plurality of pairs of rollers, each including a lower roller and an upper roller, driven at successively higher peripheral speeds for drafting respective roving and outputting the drafted rovings from between respective output roller pairs;

a suction roller engageable from above with each of said drafted rovings downstream of the respective output pair of rollers and provided with a row of perforations in a circumference of said suction roller, means for applying suction to an interior of said suction roller, and a shield in said suction roller confining the application of suction to a limited portion of said row, thereby forming a compaction zone at which suction is applied to a respective roving through the perforations along said compaction zone to condense the roving;

a driven counter roller pressing against said roving from below at a downstream end of said compaction zone and rotatable entraining said suction roller, said suction roller and said counter roller defining a nip at which a condensed roving emerges; and means for receiving said condensed roving and imparting twist to said condensed roving and for collecting the twisted condensed roving as a yarn in a yarn body, the twist imparted to said condensed roving traveling to said nip, said counter roller having a diameter which corresponds to diameters of the lower rollers of said pairs of rollers of the drafting frame, said circumference of said suction roller is metallic and said counter roller is formed with an elastic jacket.

17. A spinning machine comprising:

a drafting frame provided with a plurality of pairs of rollers, each including a lower roller and an upper roller, driven at successively higher peripheral speeds for drafting respective roving and outputting the drafted rovings from between respective output roller pairs;

a suction roller engageable from above with each of said drafted rovings downstream of the respective output pair of rollers and provided with a row of perforations in a circumference of said suction roller, means for applying suction to an interior of said suction roller, and a shield in said suction roller confining the application of suction to a limited portion of said row, thereby forming a compaction zone at which suction is applied to a respective roving through the perforations along said compaction zone to condense the roving;

a driven counter roller pressing against said roving from below at a downstream end of said compaction zone and rotatable entraining said suction roller, said suction roller and said counter roller defining a nip at which a condensed roving emerges;

means for receiving said condensed roving and imparting twist to said condensed roving and for collecting the twisted condensed roving as a yarn in a yarn body, the twist imparted to said condensed roving traveling to said nip, said counter roller having a diameter which corresponds to diameters of the lower rollers of said pairs of rollers of the drafting frame; and means for laying a core thread into said roving, thereby forming a core yarn.

18. A spinning machine comprising:

a drafting frame provided with a plurality of pairs of rollers, each including a lower roller and an upper roller, driven at successively higher peripheral speeds for drafting respective roving and outputting the drafted rovings from between respective output roller pairs;

a suction roller engageable from above with each of said drafted rovings downstream of the respective output pair of rollers and provided with a row of perforations in a circumference of said suction roller, means for applying suction to an interior of said suction roller, and a shield in said suction roller confining the application of suction to a limited portion of said row, thereby forming a compaction zone at which suction is applied to a respective roving through the perforations along said compaction zone to condense the roving;

a driven counter roller pressing against said roving from below at a downstream end of said compaction zone and rotatable entraining said suction roller, said suction roller and said counter roller defining a nip at which a condensed roving emerges; and means for receiving said condensed roving and imparting twist to said condensed roving and for collecting the twisted condensed roving as a yarn in a yarn body, the twist imparted to said condensed roving traveling to said nip, said counter roller having a diameter which corresponds to diameters of the lower rollers of said pairs of rollers of the drafting frame, said means for receiving including a spinning station provided with means for limiting thread-balloon formation, said spinning station being a ring-spinning station, said means for limiting thread-balloon formation being a spinning finger on a spindle of said ring-spinning station.

* * * * *